US011541657B2

(12) United States Patent
Takeuchi

(10) Patent No.: US 11,541,657 B2
(45) Date of Patent: Jan. 3, 2023

(54) LIQUID DISCHARGE HEAD, LIQUID DISCHARGE DEVICE, AND LIQUID DISCHARGE APPARATUS

(71) Applicant: Noriyasu Takeuchi, Kanagawa (JP)

(72) Inventor: Noriyasu Takeuchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/380,025

(22) Filed: Jul. 20, 2021

(65) Prior Publication Data

US 2022/0055367 A1 Feb. 24, 2022

(30) Foreign Application Priority Data

Aug. 19, 2020 (JP) ..... JP2020-138709

(51) Int. Cl.
*B41J 2/045* (2006.01)
*B41J 2/155* (2006.01)

(52) U.S. Cl.
CPC ..... *B41J 2/04563* (2013.01); *B41J 2/04581* (2013.01); *B41J 2/155* (2013.01)

(58) Field of Classification Search
CPC .... B41J 2/04563; B41J 2/04581; B41J 2/175; B41J 2/155
See application file for complete search history.

(56) References Cited

U.S. PATENT DOCUMENTS

2005/0190240 A1 9/2005 Takatsuka
2011/0298876 A1 12/2011 Takeuchi et al.
2012/0086762 A1 4/2012 Noguchi et al.
2012/0147103 A1 6/2012 Hasegawa et al.
2012/0176456 A1 7/2012 Maekawa et al.
2012/0242768 A1 9/2012 Seno et al.
2013/0065024 A1 3/2013 Aruga et al.
2014/0043393 A1 2/2014 Takeuchi
2015/0077469 A1 3/2015 Kohda et al.
2016/0297195 A1 10/2016 Takeuchi
2019/0217607 A1 7/2019 Akiyama et al.
2020/0031125 A1 1/2020 Takeuchi
2020/0171828 A1 6/2020 Matsufuji et al.

FOREIGN PATENT DOCUMENTS

JP 2004-322411 11/2004
JP 2017-065041 4/2017
JP 2017-185732 A 10/2017
JP 2019-123115 7/2019
JP 2019-142112 8/2019

OTHER PUBLICATIONS

Extended European Search Report dated Dec. 21, 2021, in corresponding European Patent Application No. 21183636.6.

*Primary Examiner* — Jannelle M Lebron
(74) *Attorney, Agent, or Firm* — Xsensus LLP

(57) ABSTRACT

A liquid discharge head includes a nozzle from which a liquid is dischargeable in a liquid discharge direction, an individual chamber communicating with the nozzle, a common chamber configured to store the liquid to be supplied to the individual chamber, a pressure generator configured to apply pressure to the liquid in the individual chamber, a holder holding the pressure generator, a first temperature detector adjacent to the common chamber, the first temperature detector configured to detect temperature proximate to the common chamber, and a second temperature detector held by the holder, the second temperature detector configured to detect temperature of the holder.

10 Claims, 6 Drawing Sheets

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-138709, filed on Aug. 19, 2020, in the Japan Patent Office, the entire disclosures of which is hereby incorporated by reference herein.

BACKGROUND

Technical Field

Aspects of the present disclosure relate to a liquid discharge head, a liquid discharge device, and a liquid discharge apparatus.

Related Art

Generally, viscosity characteristics of a discharged liquid have temperature dependency. A speed and a capacity of the discharge liquid are affected by the viscosity of the discharge liquid. Thus, temperature of a discharge liquid is detected to control drive signals to obtain a stable image that does not depend on an environment and a driving condition.

Therefore, the liquid discharge head includes a temperature detector to detect temperature of a discharge liquid since highly accurate detection of the temperature of the discharge liquid leads to high image quality of the printed material.

SUMMARY

In an aspect of this disclosure, a liquid discharge head includes a nozzle from which a liquid is dischargeable in a liquid discharge direction, an individual chamber communicating with the nozzle, a common chamber configured to store the liquid to be supplied to the individual chamber, a pressure generator configured to apply pressure to the liquid in the individual chamber, a holder holding the pressure generator, a first temperature detector adjacent to the common chamber, the first temperature detector configured to detect temperature proximate to the common chamber, and a second temperature detector held by the holder, the second temperature detector configured to detect temperature of the holder.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
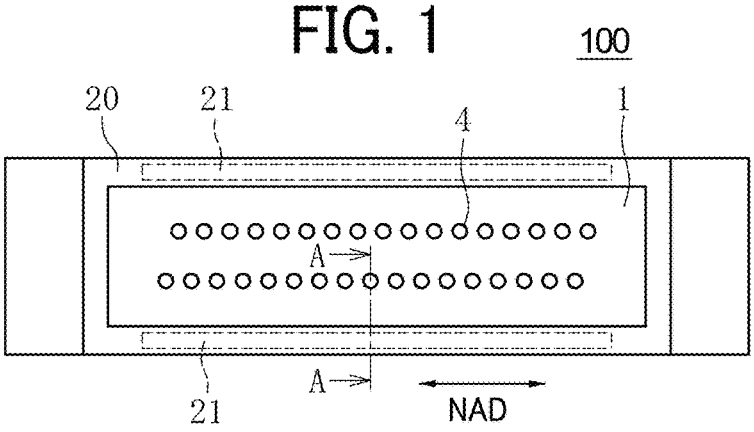
FIG. 1 is a plan view of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Embodiments of the present disclosure are described below with reference to the attached drawings. A liquid discharge head 100 according to a first embodiment of the present disclosure is described below with reference to FIGS. 1 to 3. Hereinafter, "the liquid discharge head 100" is simply referred to as a "head 100".

FIG. 1 is a plan view of the head 100 according to the first embodiment of the present disclosure.

Figure 2:
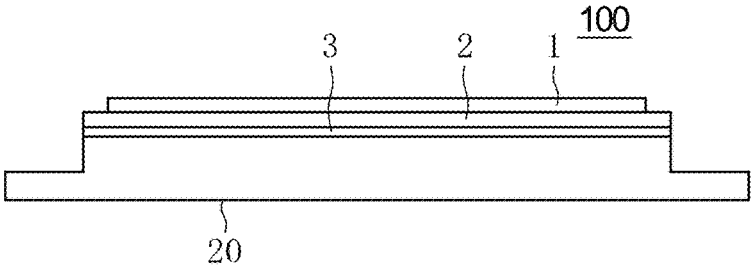
FIG. 2 is a schematic side view of the liquid discharge head according to the first embodiment of the present disclosure.

FIG. 2 is a side view of the head 100 according to the first embodiment of the present disclosure.

Figure 3:
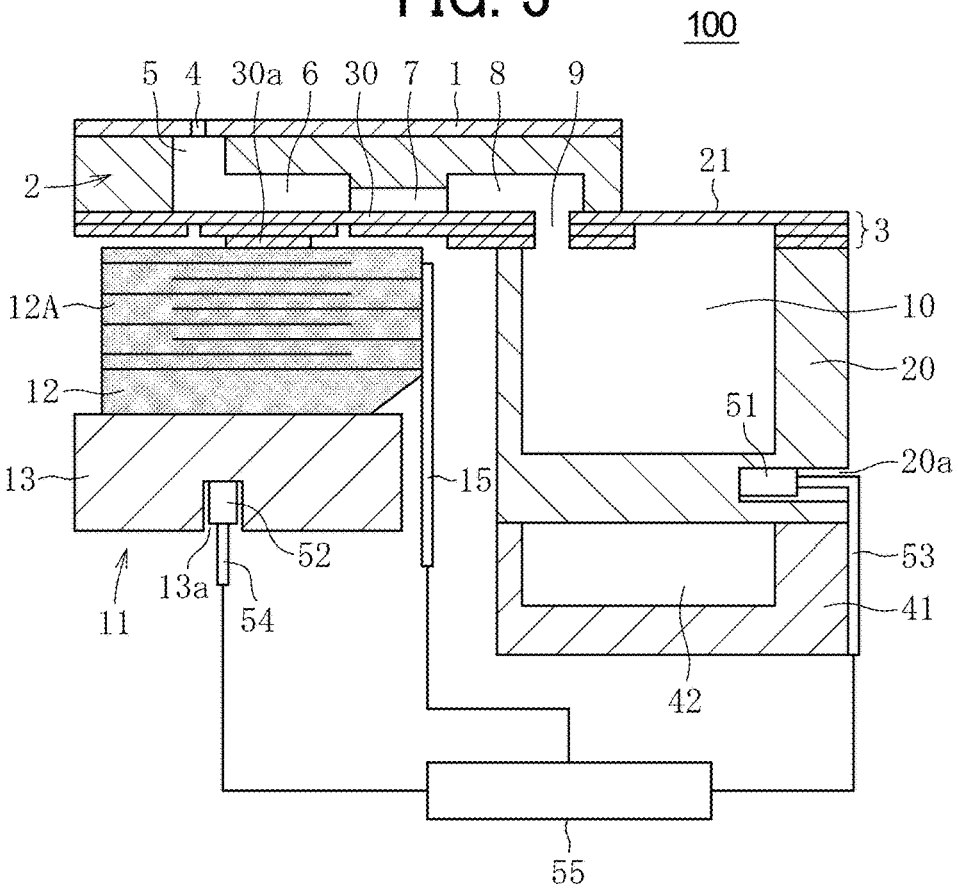
FIG. 3 is a partial cross-sectional view of the liquid discharge head along a line A-A indicated in FIG. 1 in a direction perpendicular to a nozzle array direction.

FIG. 3 is a partial cross-sectional view of the head 100 along a line A-A indicated in FIG. 1 in a direction perpendicular to a nozzle array direction indicated by arrow "NAD" in FIG. 1. Nozzles 4 are arrayed in row in the nozzle array direction NAD.

The head 100 according to the first embodiment of the present disclosure includes a nozzle plate 1, a channel plate 2, and a diaphragm 3 as a wall that are laminated one on another and bonded to each other. The head 100 further includes a piezoelectric actuator 11 to displace vibration regions 30 (vibration plate) of a diaphragm 3 and a common chamber member 20 also serving as a frame of the head 100.

The nozzle plate 1 includes two rows of nozzle arrays in each of which a plurality of nozzles 4 to discharge a liquid is arrayed in the nozzle array direction NAD that is a lateral direction (longitudinal direction of the head 100) in FIG. 1.

The channel plate 2 includes through-holes and grooves that form nozzle communication channels 5 communicated with the nozzles 4, individual chambers 6 communicated with the nozzles 4 via the nozzle communication channels 5, fluid restrictors 7 respectively communicated with the individual chambers 6, and one or more liquid introduction portions 8 communicated with one or more fluid restrictors 7.

The diaphragm 3 includes deformable vibration regions 30 serving as a wall of the individual chambers 6 of the channel plate 2. Here, the diaphragm 3 has a three-layer structure and includes a first layer forming a thin portion, a second layer and a third layer forming a thick portion in this order from a side facing the channel plate 2. Note that the structure of the diaphragm is not limited to such a three-layer structure and may be any suitable layer structure. The first layer of the diaphragm 3 includes a deformable vibration regions 30 positioned corresponding to the individual chambers 6.

The piezoelectric actuator 11 is disposed opposite to the individual chambers 6 via the diaphragm 3. The piezoelectric actuator 11 includes a piezoelectric member 12 as a pressure generator and a base 13 as a holder to hold the piezoelectric member 12. The piezoelectric member 12 includes a piezoelectric element 12A which is an electromechanical conversion element as a driver (actuator) to deform the vibration region 30 of the diaphragm 3.

The base 13 is a metal member extending in the nozzle array direction NAD. The piezoelectric members 12 are bonded onto the base 13 so that the piezoelectric members 12 are held by the base 13 over the nozzle array direction NAD. In the piezoelectric member 12, a required number of columnar piezoelectric elements 12A are formed in a comb shape at predetermined intervals in the nozzle array direction NAD by groove processing using half-cut dicing.

The piezoelectric elements 12A are respectively joined (bonded) to convex portions 30*a*. The convex portions 30*a* are thick portions having an island-like form formed on the vibration regions 30 of the diaphragm 3.

The piezoelectric member 12 includes piezoelectric layers and internal electrodes alternately laminated on each other. Each internal electrode is pulled out to an end surface of the piezoelectric member 12 to form an external electrode. The external electrode is connected to a flexible wiring member 15.

The piezoelectric member 12 is connected to the controller 55 via the flexible wiring member 15, a substrate in the head 100, or the like.

The controller 55 is provided, for example, in a liquid discharge apparatus 1000 (see FIG. 6 as described in detail below) that includes the head 100. However, the controller 55 may be provided inside the head 100.

The common chamber 10 is formed and defined inside the common chamber member 20. The common chamber 10 communicates with the liquid introduction portion 8 via an opening 9 in the diaphragm 3. Further, the common chamber 10 includes a damper 21 forming a wall of the common chamber 10. The common chamber 10 stores the liquid to be supplied to the individual chambers 6.

In the head 100, for example, when the controller 55 lowers a voltage applied to the piezoelectric element 12A from a reference potential (intermediate potential), the piezoelectric element 12A contracts. Accordingly, the vibration region 30 of the diaphragm 3 is pulled and the volume of the individual chamber 6 increases, thus causing liquid to flow into the individual chamber 6.

When the controller 55 raises the voltage applied to the piezoelectric element 12A, the piezoelectric element 12A expands in the direction of lamination. Thus, the vibration region 30 of the diaphragm 3 deforms in a direction toward the nozzle 4 and contracts the volume of the individual chamber 6. Thus, liquid in the individual chamber 6 is pressurized and discharged from the nozzle 4. Thus, the piezoelectric element 12A can apply pressure to the liquid in the individual chamber 6.

A drive method of the head 100 is not limited to the above-described method (i.e., pull-push discharging). A way of discharging changes depending on how a drive waveform is applied to the piezoelectric element 12A. For example, pull discharging or push discharging is possible.

Next, a temperature controller in the head 100 according to the present embodiment is described below.

The head 100 in the present embodiment includes a temperature control channel member 41 forming a temperature controller. The temperature control channel member 41 is disposed on an outer surface of the common chamber member 20.

Figure 4:
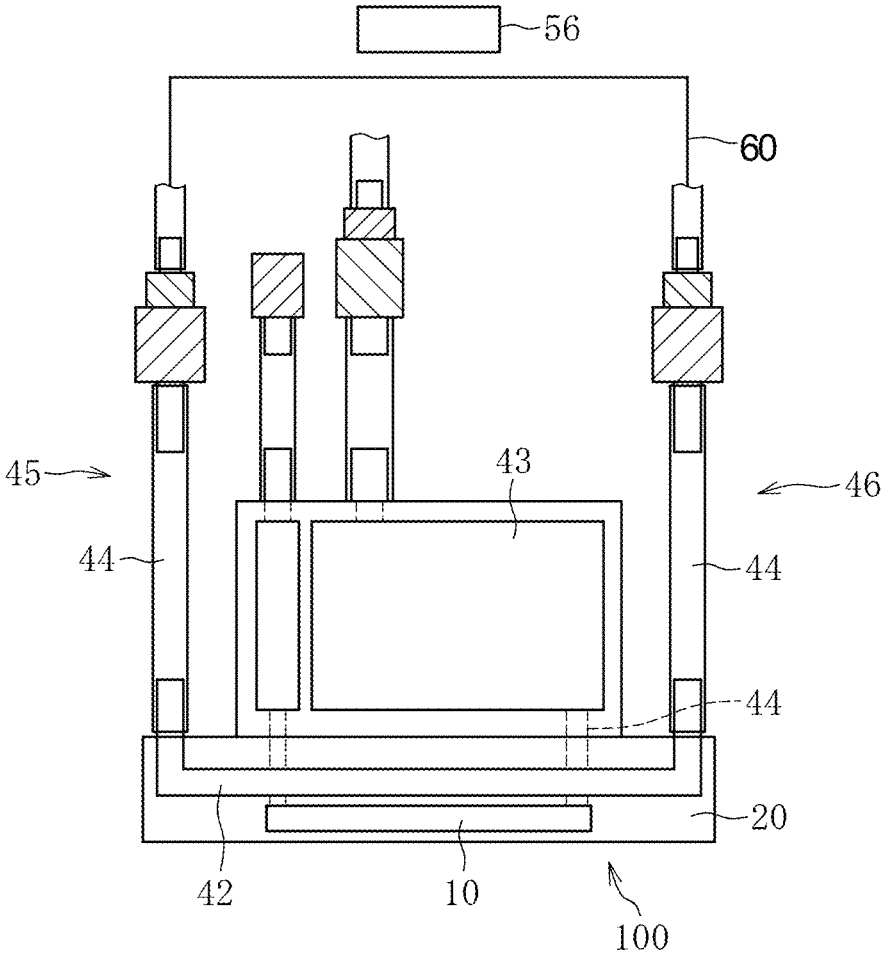
FIG. 4 is a schematic front view illustrating a storage and a connector to connect a temperature control channel to an exterior of the temperature control channel.

The temperature control channel member 41 forms a temperature control channel 42 through which a temperature control fluid flows. The temperature control fluid heats or cools the liquid supplied to the individual chamber 6 in the common chamber 10 to control (adjust) a temperature of the liquid in the common chamber 10. The temperature control channel 42 is parallel to the common chamber 10 via the common chamber member 20. The temperature control channel 42 extends in parallel with the common chamber 10 in the nozzle array direction NAD (direction perpendicular to a paper surface of FIG. 3). Here, the nozzle array direction NAD is parallel with a longitudinal direction of the common chamber as illustrated in FIG. 4. Thus, the temperature control channel 42 extends in parallel with the common chamber 10 in the longitudinal direction of the common chamber 10. In other words, the temperature control channel 42 is stacked on the common chamber 10 in a liquid discharge direction from the nozzle 4 that is a vertical direction in FIG. 3. The head 100 discharge the liquid from the nozzle 4 in the liquid discharge direction.

The temperature control fluid passing through the temperature control channel 42 can control (adjust) a temperature of the liquid in the common chamber 10 by heat conduction via the common chamber member 20. As the temperature control fluid, for example, hot water or cooling water may be used. In addition, the temperature control channel 42 is in parallel with the common chamber 10 so that the head 100 can increase a heat exchange efficiency between a discharge liquid in the common chamber 10 and the temperature control fluid in the temperature control channel 42.

FIG. 4 is a schematic front view illustrating a storage 43 to supply the discharge liquid to the common chamber 10 and a connector to connect the temperature control channel 42 to an exterior of the temperature control channel 42.

As illustrated in FIG. 4, one end of the common chamber 10 is connected to the storage 43 of the discharge liquid via a tube 44. The common chamber 10 is supplied with the discharge liquid from the storage 43 via the tube 44. The storage 43 is connected an exterior of the head 100, and the discharge liquid is supplied from the exterior of the head 100 to the storage 43 of the head 100. Another end of the common chamber 10 is connected to a discharge channel to discharge the discharge liquid outside the head 100.

The temperature control channel 42 includes an inflow part 45 at one end of the temperature control channel 42. The inflow part 45 includes a tube 44 or the like. The inflow part 45 connects the temperature control channel 42 of the head 100 with an exterior of head 100 and supplies the temperature control fluid to the temperature control channel 42 of the head 100. The temperature control channel 42 includes a discharge part 46 at another end of the temperature control channel 42. The discharge part 46 includes a tube 44 or the like. The discharge part 46 enables the temperature control fluid to be discharged from the temperature control channel 42 to the exterior of the head 100.

Thus, the temperature control fluid circulates between an exterior channel 60 of the temperature control fluid disposed outside the head 100 and the temperature control channel 42. For example, the temperature control fluid circulates from the exterior channel 60 through the inflow part 45, the temperature control channel 42, and the discharge part 46 again to the exterior channel 60 outside the head 100.

A temperature controller 56 outside the head 100 can control a temperature of the temperature control fluid circulating in the liquid discharge apparatus 1000. The controller 55 controls the temperature controller 56, for example. The temperature controller 56 outside the head 100 can control the temperature of the discharge liquid without increasing a size of the head 100.

The temperature controller 56 controls and reduces a temperature change of the discharge liquid to reduce a variation in physical properties of the discharge liquid to stably discharge the discharge liquid even when a liquid, viscosity or surface tension of which varies depending on the temperature, is used as the discharge liquid.

Next, a temperature detector to detect the temperature of the discharge liquid is described below.

As illustrated in FIG. 3, the common chamber member 20 includes a hole 20*a*. The head 100 includes a first thermistor 51 as a first temperature detector inside the hole 20*a*. The hole 20*a* is an opening formed on a side surface of the common chamber member 20. The hole 20*a* is disposed at a position adjacent to the common chamber 10 inside the common chamber member 20. The first thermistor 51 is connected to a lead wire 53 and is connected to the controller 55 via the lead wire 53 or the like. The first thermistor 51 detects temperature proximate to the common chamber 10 in the common chamber member 20.

The first thermistor 51 is disposed between the common chamber 10 and the temperature control channel 42 in the common chamber member 20. Specifically, the first thermistor 51 is disposed at a position adjacent to the common chamber 10. Especially, the first thermistor 51 is disposed closer to the common chamber 10 than the temperature control channel 42 in a liquid discharge direction in which the discharge liquid is discharged. Further, the hole 20*a* opens to a side opposite to the piezoelectric member 12 (right-side of the piezoelectric member 12 in FIG. 3). The first thermistor 51 is disposed at a position distant from the piezoelectric member 12.

The first thermistor 51 disposed at a position closer to the common chamber 10 than the temperature control channel 42 can detect a temperature closer to the liquid in the common chamber 10. Further, the hole 20*a* is opened toward an end (right end in FIG. 3) of the common chamber member 20 opposite to the piezoelectric member 12.

Thus, it is possible to prevent the first thermistor 51 from being affected by heat generated by the piezoelectric member 12. Further, the hole 20*a* is opened outward of the head 100 so that it is easier to insert the first thermistor 51 into the hole 20*a* and facilitate wiring of the lead wires 53. Thus, the above configuration of the hole 20*a* is preferable.

Further, the hole 20*a* having the above configuration can easily provide a space for arranging the first thermistor 51 between the common chamber 10 and the temperature control channel 42 in the common chamber member 20. According to an arrangement of the hole 20*a* in the present embodiment, it is possible to arrange the first thermistor 51 in the head 100 without expanding a size of the head 100 in a width direction of the head 100 (left-right direction in FIG. 3), that is a direction perpendicular to the nozzle array direction NAD.

However, the arrangement of the first thermistor 51 is not limited the configuration as described above. For example, if a space permits, the first thermistor 51 may be provided on a left-end or a right-end of side surfaces of the common chamber 10 in the common chamber member 20 in FIG. 3.

The base 13 includes a hole 13*a*. The head 100 includes a second thermistor 52 as a second temperature detector inside the hole 13*a*. The hole 13*a* is a hole opened on a lower surface of the base 13, that is an end surface of the base 13 opposite to the piezoelectric member 12. The second thermistor 52 is connected to a lead wire 54 and is connected to the controller 55 via the lead wire 54 or the like. The second thermistor 52 detects temperature of the base 13.

A presence or an absence of liquid discharge in each of the multiple nozzles 4 arrayed is different from each other according to a pattern of an image to be formed. Thus, an amount of heat generated by the piezoelectric member 12 also varies in the nozzle array direction NAD. However, since the base 13 is a metal member extending in the nozzle array direction NAD as described above, the base 13 can evenly distribute the heat in the nozzle array direction NAD to make a heat distribution in the base 13 uniform.

Therefore, the base 13 can further evenly distribute (average) the detected temperature of the second thermistor 52. Further, the hole 13*a* is opened on a lower end of the base 13 opposite to the piezoelectric member 12, and the second thermistor 52 is disposed far (away) from the piezoelectric member 12. Thus, the second thermistor 52 can detect further averaged temperature.

The controller 55 of the present embodiment changes a control of the head 100 based on detection results of temperature detected by the first thermistor 51 and the second thermistor 52. Specifically, the controller 55 applies a drive waveform to the piezoelectric element 12A. The drive waveform is based on the temperatures detected by the first thermistor 51 and the second thermistors 52.

Thus, the head 100 can change a control of a discharge process according to change in the physical properties of the discharge liquid for each temperature even if the temperature of the discharge liquid fluctuates due to external or internal factors. However, the controller 55 may change other discharge conditions such as a discharge amount of the liquid based on the detection results of the temperature detected by the first thermistor 51 and the second thermistor 52.

The liquid discharged by the head 100 is heated by the piezoelectric element 12A. Thus, the temperature of the liquid increases when the discharge liquid passes through the individual chambers 6 connected to the piezoelectric element 12A. Therefore, the head 100 preferably detects the temperature of the liquid immediately before the liquid discharge to accurately detect the temperature of the discharge liquid.

Further, the head 100 preferably includes the temperature detector (the first thermistor 51 and the second thermistor 52) at a position adjacent to the individual chamber 6. However, it is difficult to secure a space for arranging the temperature detector in the vicinity of the individual chamber 6 due to a structure of the head 100. Thus, provision of the temperature detector may increase the size of the head 100.

Conversely, since the base 13 and the common chamber member 20 forming the common chamber 10 are relatively large members, it is easy to secure a space for arranging the temperature detector inside the base 13 or the common chamber member 20.

As described above, the head according to the present embodiment includes the first thermistor 51 and the second thermistor 52 respectively disposed inside the common chamber member 20 adjacent to the common chamber 10 and the base 13. Thus, the above configuration of the temperature detector can reduce the size of the head 100. The thermistors (first thermistor 51 and second thermistor 52) can detect the temperature of the discharge liquid with high accuracy by the method described below.

Figure 5:
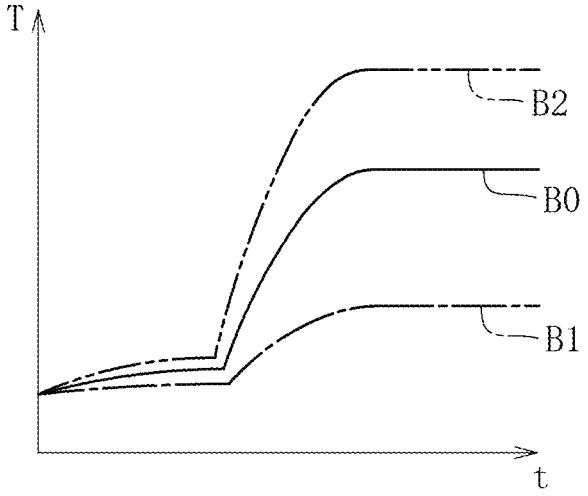
FIG. 5 is a graph illustrating a relationship between a liquid discharge time of the liquid discharge head and each temperature of a discharge liquid.

FIG. 5 is a graph illustrating a relationship between a liquid discharge time of the head 100 and each temperature of the discharge liquid. A horizontal axis in FIG. 5 represents the liquid discharge time during which the head 100 continuously discharges the liquid.

A vertical axis in FIG. 5 represents the temperature of the discharge liquid. In FIG. 5, a solid line B0 indicates the temperature of the discharge liquid in the individual chamber 6. A dash-single-dot line B1 in FIG. 5 indicates the temperature detected by the first thermistor 51. A dash-double-dot line B2 in FIG. 5 indicates the temperature detected by the second thermistor 52.

A thermistor different from the thermistors as described above is disposed at a position of a surface of the individual chamber 6 adjacent to the nozzle 4 for convenience in an experiment. The temperature of the discharge liquid in the individual chamber 6 indicated by the solid line B0 was measured.

As illustrated in FIG. 5, the temperature becomes higher in an order of the dash-single-dot line B1< the solid line B0< the dash-double-dot line B2. The temperature B0 of the discharge liquid in the individual chamber 6 becomes a value between the temperature B1 detected by the first thermistor 51 and the temperature B2 detected by the second thermistor 52.

That is, since the base 13 is heated by heat transferred from the piezoelectric element 12A similarly to the discharge liquid. Thus, the temperature detected by the second thermistor 52 increases. Particularly, the temperature B2 of the base 13 in direct contact with the piezoelectric element 12A becomes higher than the temperature B0 of the discharge liquid in the individual chamber 6 as illustrated in FIG. 5.

Conversely, the temperature B1 of the discharge liquid in the common chamber 10 disposed upstream of the individual chamber 6, that is, the temperature detected by the first thermistor 51 becomes lower than the temperature B0 of the discharge liquid in the individual chamber 6. From the above, the detected temperatures B0, B1, and B2 are as illustrated in FIG. 5.

Specifically, the temperature B0 of the discharge liquid in the individual chamber 6 is a value between the temperature B1 detected by the first thermistor 51 and the temperature B2 detected by the second thermistor 52. Particularly, the temperature B0 of the discharge liquid in the individual chamber 6 is substantially an intermediate value between the temperature B1 detected by the first thermistor 51 and the temperature B2 detected by the second thermistor 52 in the head 100 according to the present embodiment.

In view of the above results illustrated in FIG. 5, the controller 55 calculates an average value of the temperature detected by the first thermistor 51 and the second thermistor 52 in the head 100 according to the present embodiment. Further, the controller 55 uses this average value as the temperature of the discharge liquid to control the temperature. Accordingly, the controller 55 can detect (calculate) a temperature closer to the actual temperature of the discharge liquid.

Thus, the controller 55 can control the head 100 at a temperature closer to the actual temperature of the discharge liquid. Therefore, the liquid discharge apparatus 1000 (for example, an image forming apparatus) including the head 100 can discharge a discharge liquid at a stable temperature or under a stable condition regardless of an environmental temperature around the liquid discharge apparatus 1000 or a temperature variation during driving of the liquid discharge apparatus 1000. Therefore, the image forming apparatus can stably form a high-quality image.

As described above, the head 100 in the present embodiment can reduce the size of the head 100 and also highly accurately detect the temperature of the discharge liquid in the head 100. The head 100 in the present embodiment uses the average value of the temperatures detected by the first thermistor 51 and the second thermistor 52.

However, a ratio of the temperature detected by the first thermistor 51 to the temperature detected by the second thermistor 52 can be appropriately changed, and an optimum ratio can be adopted by using an actual measurement (detection) result or the like.

For example, the controller 55 may set a value obtained by adding a certain threshold value to the calculated average value as a temperature corresponding to a liquid temperature in the individual chamber 6, and control the piezoelectric member 12 or control the liquid temperature as described below. The value obtained by adding the certain threshold value to the calculated average value is also simply referred to as a "calculated value".

Further, the calculated value as described above may be used for controlling the temperature of the temperature control channel as an operation after the controller 55 detects (calculates) the temperature. That is, when the calculated value is equal to or larger than the threshold value, the controller 55 may control to decrease the temperature of the liquid flowing in the temperature control channel.

The temperature condition at the time of liquid discharge may greatly affect the image quality or the like depending on the type of the liquid to be discharged. In such a case, the controller 55 performs the above-described control to keep the temperature of the liquid at the best temperature and improve the image quality and the like.

Figure 6:
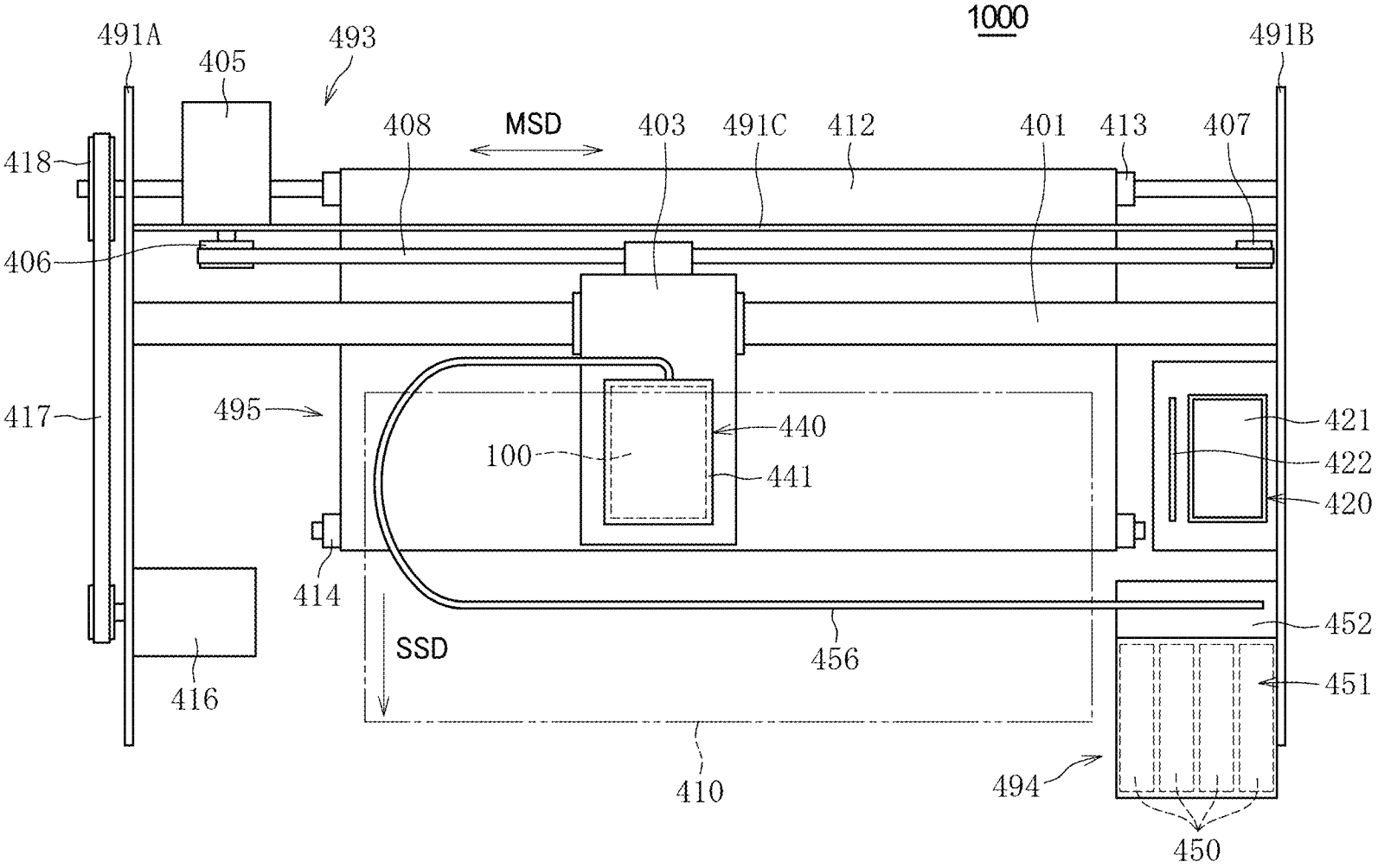
FIG. 6 is a plan view of a main part of a liquid discharge apparatus according to an embodiment of the present disclosure.
Figure 7:
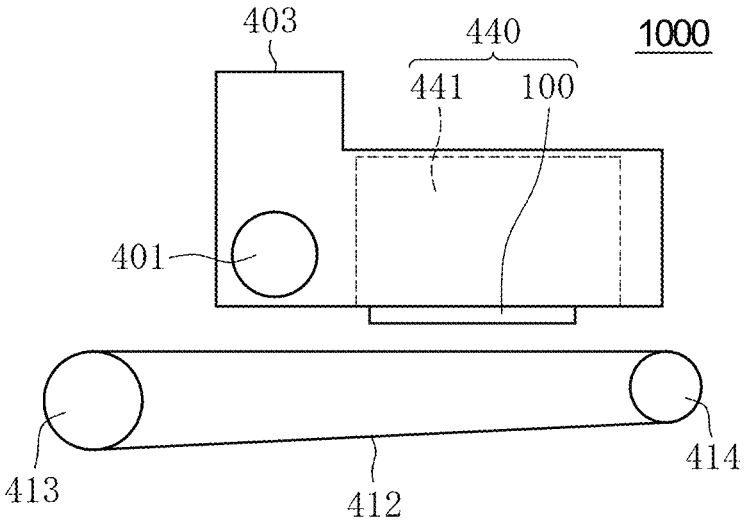
FIG. 7 is a schematic side view of a main portion of the liquid discharge apparatus.

Next, an example of the liquid discharge apparatus 1000 according to an embodiment of the present disclosure is described with reference to FIGS. 6 and 7. FIG. 6 is a plan view of a portion of the liquid discharge apparatus 1000. FIG. 7 is a side view of a portion of the liquid discharge apparatus 1000 of FIG. 6.

The liquid discharge apparatus 1000 is a serial type apparatus, and the carriage 403 reciprocally moves in the main scanning direction as indicated by arrow "MSD" by a main scan moving unit 493. The main scan moving unit 493 includes a guide 401, a main scan motor 405, a timing belt 408, and the like. The guide 401 is bridged between a left-side plate 491A and a right-side plate 491B to moveably hold the carriage 403. The main scan motor 405 reciprocally moves the carriage 403 in the main scanning direction MSD via the timing belt 408 bridged between a drive pulley 406 and a driven pulley 407.

The carriage 403 mounts a liquid discharge device 440. The head 100 and a head tank 441 forms the liquid discharge device 440 as a single unit. The head 100 has a configuration of one of the head 100 illustrated in FIGS. 1 to 5. The head 100 of the liquid discharge device 440 discharges color liquids of, for example, yellow (Y), cyan (C), magenta (M), and black (K).

The head 100 includes a nozzle array including the plurality of nozzles 4 arrayed in row in a sub scanning direction indicated by arrow "SSD" perpendicular to the main scanning direction MSD in FIG. 6. The head 100 is mounted to the carriage 403 so that liquid droplets (ink droplets) are discharged downward from the nozzles 4.

The liquid stored in liquid cartridges 450 are supplied to the head tank 441 by a supply unit 494 to supply the liquid stored outside the head 100 to the head 100.

The supply unit 494 includes a cartridge holder 451 which is a filling part to mount the liquid cartridges 450, a tube 456, a liquid feed unit 452 including a liquid feed pump, and the like. The liquid cartridge 450 is detachably mounted on the cartridge holder 451. The liquid is fed from the liquid cartridge 450 to the head tank 441 by the liquid feed unit 452 via the tube 456. The head tank 441 stores the liquid to be supplied to the head 100.

The liquid discharge apparatus 1000 includes a conveyor 495 to convey a sheet 410. The conveyor 495 includes a conveyance belt 412 as a conveyor and a sub scan motor 416 to drive the conveyance belt 412.

The conveyance belt 412 attracts the sheet 410 and conveys the sheet 410 at a position facing the head 100. The conveyance belt 412 is an endless belt stretched between a conveyance roller 413 and a tension roller 414. Attraction of the sheet 410 to the conveyance belt 412 may be applied by electrostatic adsorption, air suction, or the like.

The conveyance belt 412 rotates in the sub scanning direction SSD as the conveyance roller 413 is rotationally driven by the sub scan motor 416 via the timing belt 417 and the timing pulley 418.

At one side in the main scanning direction MSD of the carriage 403, a maintenance unit 420 to maintain the head 100 in good condition is disposed on a lateral side (right side in FIG. 6) of the conveyance belt 412.

The maintenance unit 420 includes, for example, a cap 421 to cap a nozzle surface of the head 100, a wiper 422 to wipe the nozzle surface, and the like. The nozzle surface is an outer surface of the nozzle plate 1 (see FIGS. 2 and 3) on which the nozzles 4 are formed.

The main scan moving unit 493, the supply unit 494, the maintenance unit 420, and the conveyor 495 are mounted to a housing that includes a left-side plate 491A, a right-side plate 491B, and a rear-side plate 491C.

In the liquid discharge apparatus 1000 thus configured, the sheet 410 is conveyed on and attracted to the conveyance belt 412 and is conveyed in the sub scanning direction SSD by the cyclic rotation of the conveyance belt 412.

The head 100 is driven in response to image signals while the carriage 403 moves in the main scanning direction MSD, to discharge liquid to the sheet 410 stopped, thus forming an image on the sheet 410.

Next, the liquid discharge device 440 according to another embodiment of the present disclosure is described with reference to FIG. 8.

Figure 8:
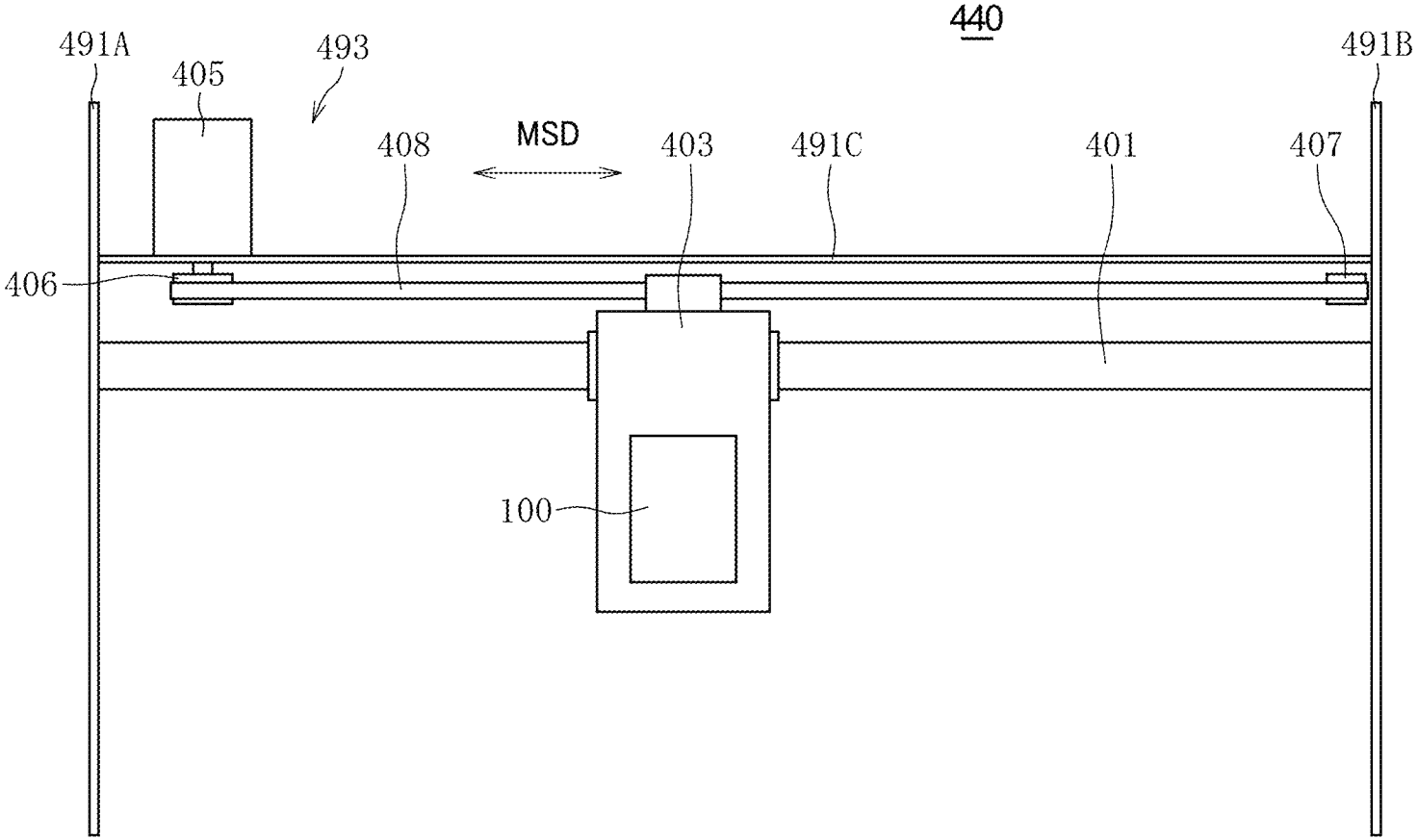
FIG. 8 is a schematic plan view of a portion of another example of a liquid discharge device according to an embodiment of the present disclosure.

FIG. 8 is a plan view of a portion of the liquid discharge device 440 according to another embodiment of the present disclosure.

The liquid discharge device 440 includes a housing, the main scan moving unit 493, the carriage 403, and the head 100 among components of the liquid discharge apparatus 1000. The left-side plate 491A, the right-side plate 491B, and the rear-side plate 491C form the housing.

The liquid discharge device 440 may be configured to further attach at least one of the above-described maintenance unit 420 and the supply unit 494 to, for example, the right-side plate 491B of the liquid discharge device 440.

Figure 9:
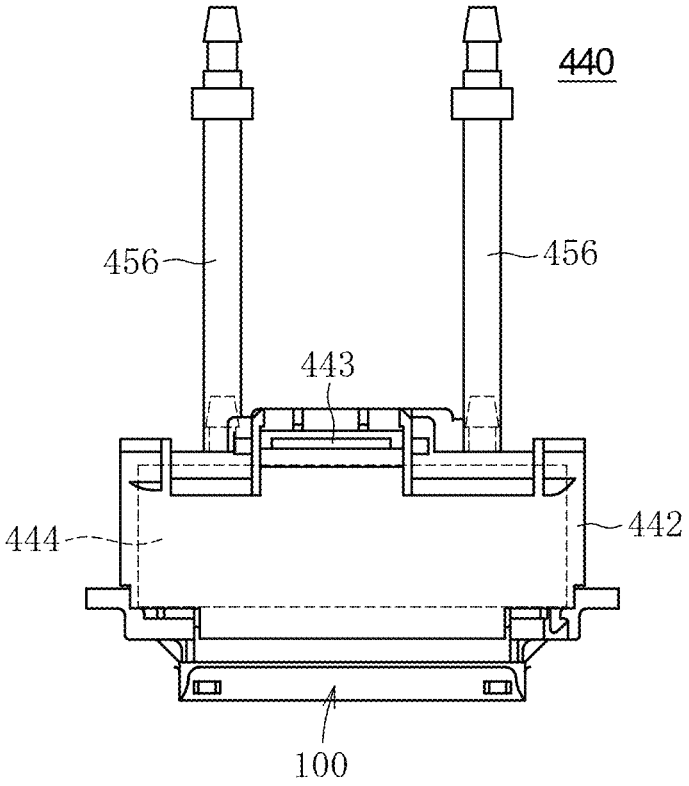
FIG. 9 is a schematic front view of still another example of the liquid discharge device according to an embodiment of the present disclosure.

Next, still another example of the liquid discharge device 440 according to the present embodiment is described with reference to FIG. 9. FIG. 9 is a front view of still another example of the liquid discharge device 440.

The liquid discharge device 440 includes the head 100 to which a channel part 444 as a liquid supply member is mounted and a tube 456 connected to the channel part 444.

Further, the channel part 444 is disposed inside a cover 442. In some embodiments, the liquid discharge device 440 may include the head tank 441 instead of the channel part 444. A connector 443 electrically connected with the head 100 is provided on an upper part of the channel part 444.

The above-described temperature detector may also be disposed in the head 100 in the above-described liquid discharge apparatus 1000 or liquid discharge device 440. Thus, the head 100 can reduce a size of the head 100 and accurately detect the temperature of the discharge liquid.

In the present embodiments, a "liquid" discharged from the head is not particularly limited as long as the liquid has a viscosity and surface tension of degrees dischargeable from the head.

Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge.

The term "liquid discharge device" represents a structure including the head and a functional part(s) or unit(s) combined to the head to form a single unit.

For example, the "liquid discharge device" includes a combination of the head with at least one of a head tank, a carriage, a supply unit, a maintenance unit, and a main scan moving unit to form a single unit.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

For example, the head and the head tank may form the liquid discharge device as a single unit.

Alternatively, the head and the head tank coupled (connected) with a tube or the like may form the liquid discharge device as a single unit.

A unit including a filter may be added at a position between the head tank and the head of the liquid discharge device.

In another example, the head and the carriage may form the liquid discharge device as a single unit.

In still another example, the liquid discharge device includes the head movably held by a guide that forms part of a main scan moving unit, so that the head and the main scan moving unit form a single unit.

The liquid discharge device may include the head, the carriage, and the main scan moving unit that form a single unit.

In still another example, a cap that forms a part of the maintenance unit may be secured to the carriage mounting the head so that the head, the carriage, and the maintenance unit form a single unit to form the liquid discharge device.

Further, in another example, the liquid discharge device includes a tube connected to the head mounting the head tank or the channel part so that the head and the supply unit form a single unit.

The main scan moving unit may be a guide only. The supply unit may be a tube(s) only or a loading unit only.

In the above-described embodiments, the "liquid discharge apparatus" includes the head or the liquid discharge device and drives the head to discharge liquid. The liquid discharge apparatus may be, for example, an apparatus capable of discharging liquid to a material onto which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The liquid discharge apparatus is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material onto which liquid at least temporarily adheres, a material onto which liquid adheres and fixes, or a material onto which liquid adheres to permeate.

Examples of the "material onto which liquid can adhere" include recording media such as a paper sheet, recording paper, and a recording sheet of paper, film, and cloth, electronic components such as an electronic substrate and a piezoelectric element, and media such as a powder layer, an organ model, and a testing cell.

The "material onto which liquid can adhere" includes any material on which liquid adheres unless particularly limited.

Examples of the "material onto which liquid can adhere" include any materials on which liquid can adhere even temporarily, such as paper, thread, fiber, fabric, leather, metal, plastic, glass, wood, and ceramic.

The liquid discharge apparatus may be an apparatus to relatively move the head and a material on which liquid can adhere. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet surface to coat the treatment liquid on the sheet surface to reform the sheet surface and an injection granulation apparatus in which a composition liquid including raw materials dispersed in a solution is injected through nozzles to granulate fine particles of the raw materials.

The terms "image formation", "recording", "printing", "image printing", and "fabricating" used in the present embodiments may be used synonymously with each other. Thus, the head 100 can reduce a size of the head 100 and accurately detect the temperature of the liquid to be discharged.

Each of the functions of the controller 55 and the temperature controller 56 in the above described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a nozzle from which a liquid is dischargeable in a liquid discharge direction;

an individual chamber communicating with the nozzle;

a common chamber to store the liquid to be supplied to the individual chamber;

a pressure generator to apply pressure to the liquid in the individual chamber;

a holder holding the pressure generator;

a first temperature detector adjacent to the common chamber, the first temperature detector to detect temperature proximate to the common chamber;

a second temperature detector held by the holder, the second temperature detector to detect temperature of the holder;

a common chamber member forming the common chamber, the common chamber member including a hole adjacent to the common chamber, the first temperature detector being inside the hole of the common chamber member;

a temperature control channel through which a temperature control fluid flows, the temperature control fluid to control temperature of the liquid in the common chamber;

an inflow part from which the temperature control fluid flows into the temperature control channel; and a discharge part from which the temperature control fluid is discharged outside the temperature control channel.

2. The liquid discharge head according to claim 1, wherein the temperature control channel is adjacent to the common chamber in the liquid discharge direction, and the temperature control channel extends in parallel with the common chamber in a longitudinal direction of the common chamber.

3. The liquid discharge head according to claim 2, wherein the first temperature detector is between the common chamber and the temperature control channel and is closer to the common chamber than the temperature control channel in the liquid discharge direction.

4. The liquid discharge head according to claim 3, wherein the nozzle includes multiple nozzles arrayed in a nozzle array direction, the holder includes metal and extends in the nozzle array direction, the holder includes a hole on an end surface opposite to another end surface on which the pressure generator is held, and the second temperature detector is inside the hole of the holder.

5. The liquid discharge head according to claim 1, further comprising:

circuitry configured to drive the pressure generator according to a temperature detected by the first temperature detector and the second temperature detector.

6. The liquid discharge head according to claim 5, wherein the circuitry is configured to drive the pressure generator according to an average value of temperatures detected by the first temperature detector and the second temperature detector.

7. A liquid discharge device comprising:

the liquid discharge head according to claim 1, and a temperature controller configured to control temperature of the temperature control fluid according to an average value of temperatures detected by the first temperature detector and the second temperature detector.

8. A liquid discharge device comprising the liquid discharge head according to claim 1.

9. The liquid discharge device according to claim 8, further comprising at least one of:

a head tank to store the liquid to be supplied to the liquid discharge head;

a carriage mounting the liquid discharge head;

a supply to supply the liquid to the liquid discharge head;

a maintainer to maintain the liquid discharge head; and a main scan mover to move the carriage in a main scanning direction, wherein the liquid discharge head and said at least one of the head tank, the carriage, the supply, the maintainer, and the main scan mover form a single unit.

10. A liquid discharge apparatus comprising the liquid discharge device according to claim 8.

* * * * *